US008105112B2

(12) United States Patent
Midorikawa et al.

(10) Patent No.: US 8,105,112 B2
(45) Date of Patent: Jan. 31, 2012

(54) ELECTRICAL CONNECTOR

(75) Inventors: Kazuya Midorikawa, Tokyo (JP); Shohei Hosoda, Tokyo (JP)

(73) Assignee: Hirose Electric Co., Ltd, Tokyo (JP)

( * ) Notice: Subject to any disclaimer, the term of this patent is extended or adjusted under 35 U.S.C. 154(b) by 0 days.

(21) Appl. No.: 12/957,682

(22) Filed: Dec. 1, 2010

(65) Prior Publication Data

US 2011/0136379 A1 Jun. 9, 2011

(30) Foreign Application Priority Data

Dec. 3, 2009 (JP) ..... 2009-275240

(51) Int. Cl.
*H01R 13/648* (2006.01)

(52) U.S. Cl. ..... 439/607.35

(58) Field of Classification Search ..... 439/607.35, 439/607.31, 607.74
See application file for complete search history.

(56) References Cited

U.S. PATENT DOCUMENTS 6,464,515 B1 * 10/2002 Wu ..... 439/108
6,551,139 B1 * 4/2003 Yu ..... 439/607.22
6,923,659 B2 * 8/2005 Zhang et al. ..... 439/74
7,052,286 B2 * 5/2006 Zhang ..... 439/74
7,070,423 B2 * 7/2006 Zhang et al. ..... 439/74
7,074,085 B2 * 7/2006 Chen ..... 439/607.36

FOREIGN PATENT DOCUMENTS

JP 2000-500614 A 1/2000
JP 2008-146870 A 6/2008
JP 2008-226477 A 9/2008
WO 97/19498 5/1997

OTHER PUBLICATIONS

Notice of Reasons for Rejection for Japanese Patent Application 2009-275240, Japanese Patent Office, Oct. 20, 2011.

* cited by examiner

*Primary Examiner* — Tulsidas C Patel
*Assistant Examiner* — Harshad Patel
(74) *Attorney, Agent, or Firm* — Kubotera & Associates, LLC

(57) ABSTRACT

An electrical connector includes a plurality of terminals, a housing and a shield plate. The terminals are arranged and held in the housing. The shield plate is formed by bending a metal plate and attached to the housing. The housing includes a sidewall and an edge wall at an end portion of the sidewall. The shield plate includes a shield portion covering an outer surface of the sidewall and a held. The held portion is supported on a holding portion disposed on the edge wall of the housing. The shield portion includes a regulating portion capable of abutting against the outer surface of the sidewall. The regulating portion regulates deformation of the shield portion when the shield plate is attached to the housing.

4 Claims, 6 Drawing Sheets

ELECTRICAL CONNECTOR

BACKGROUND OF THE INVENTION AND RELATED ART STATEMENT

The present invention relates to an electrical connector.

A conventional electrical connector (a connector) often includes a housing and a shield plate attached to the housing. The shield plate covers a surface of a circumferential wall of the housing. For example, Patent Reference has disclosed a conventional connector including a shield plate.

Patent Reference Japanese Patent Publication No. 2008-226477

The conventional connector disclosed in Patent Reference includes a housing having a substantially rectangular parallelepiped shape and an opening portion in a center of the housing for receiving a mating connector from an upper direction. The connector further includes a plurality of the terminals. The terminal is arranged and held in a terminal holding groove (a terminal retaining cavity) formed in each of two sidewalls extending in a longitudinal direction of the housing. The two sidewalls face to each other.

In addition, the connector includes two shielding members for covering an outer surface of the sidewalls. Each of the two shielding members includes a shield portion (a main body) for covering the outer surface of the sidewall and two held portions formed by bending both ends of the shield portion. The housing further includes an edge wall situated at an end of the sidewall. The edge wall includes a holding groove extending perpendicularly to the longitudinal direction. The held portion of the shielding member is held in the holding groove, so that the shielding member is attached to the housing.

Upon attaching the shielding member to the housing, a predetermined space is generated between the terminal and the shielding member. Accordingly, it is possible to ensure an insulating distance, in other words, the shortest distance between the terminal and the shielding member.

In the conventional connector with the shield plate attached thereto in Patent Reference, the space is generated between the shield plate and the terminal in order to ensure the proper insulating distance. As a result, a space can be generated between the outer surface of the sidewall and the shield portion.

The shield portion has an elongated plate shape. Therefore, when the shield portion has the space against the outer surface of the sidewall of the housing, a middle portion thereof can be deformed toward the outer surface of the sidewall of the housing due to a manufacturing variance, an assembling variance or an inadvertent external force and the like. The insulating distance can be affected by the deformation of the shield plate, in other words, changing of an amount of the space between the shield portion and the sidewall in a thickness direction of the shield portion, since the shield portion is fixed against the housing in a vertical direction.

Accordingly, when the shield portion becomes too close to the sidewall and then the space between the shield portion and the terminal becomes excessively small, it becomes difficult to ensure the proper insulating distance. The insulating distance is determined by the amount of the space, that is, a distance between the outer surface of the sidewall and the shield portion.

In view of the problems described above, an object of the present invention is to provide an electrical connector which enables to obtain a good shielding state by maintaining a proper distance between the outer surface of the sidewall of the housing and the shield plate so that the insulating distance between the terminal and the shield plate can be maintained properly.

Further objects and advantages of the invention will be apparent from the following description of the invention.

SUMMARY OF THE INVENTION

In order to attain the objects described above, according to the present invention, an electrical connector includes a plurality of terminals; a housing for arranging and holding the terminals therein and having a substantially rectangular parallelepiped shape; and a shield plate formed by bending a metal plate and attached to the housing.

In the electrical connector according to the present invention, the housing includes a sidewall extending in a longitudinal direction thereof, in other words, a direction that the terminals are arranged. In addition, the housing includes an edge wall at an end portion of the sidewall. Further, the shield plate includes a shield portion covering an outer surface of the sidewall and a held portion formed by bending an end of the shield portion. The held portion is supported on a holding portion disposed on the edge wall of the housing. The shield portion includes a regulating portion capable of abutting against the outer surface of the sidewall.

In the present invention, the shield portion of the shield plate includes the regulating portion capable of abutting against the outer surface of the sidewall. Therefore, when the shield portion is deformed in a thickness direction thereof toward the sidewall due to a manufacturing variance, an assembling variance or an inadvertent external force and the like, the regulating portion of the shield portion abuts against the outer surface of the sidewall. Thereby, the regulating portion regulates further deformation of the shield portion. As a result, the shield portion and the terminal are able to maintain a space by a necessary distance therebetween. Thereby, it is possible to maintain an insulating distance properly.

It is preferable that the shield plate is attached to the housing so that the held portion is deformed outwardly in the longitudinal direction thereof.

When the shield plate is in a free state prior to being attached to the housing, if the held portion extends from the shield portion in an incorrect direction, in other words, the held portion has an incorrect flexion angle, the shield plate is supported on the holding portion being deformed to a correct shape. As a result, due to the deformation, it becomes difficult to maintain the insulating distance properly.

For example, when the shield plate has the flexion angle greater than a right angle in the free state and the shield plate is attached to the housing with the right angle, that is, when the held portion extends outwardly from the shield portion in the longitudinal direction, it is necessary to decrease the flexion angle of the shield plate upon attaching to the housing so that the held portion has the flexion angle of the right angle.

Consequently, the shield portion is deformed so as to be away from the outer surface of the sidewall of the housing. As a result, a space between the outer surface of the sidewall and the shield portion becomes wider. Therefore, it becomes difficult to maintain the proper insulating distance. Furthermore, since the shield portion is deformed so as to be away from the outer surface of the sidewall, the shield plate can interfere with other electrical devices adjacent to the electrical connector.

In the present invention, it is preferable that the held portion is bent outwardly in the longitudinal direction as the shield plate is attached to the housing, comparing to the free state prior to being attached to the housing. When the shield plate described above is attached to the housing, a middle portion of the shield portion in the longitudinal direction is bent toward the outer surface of the sidewall of the housing since the held portions on the both ends of the shield portion are deformed so as to be apart from each other in the longitudinal direction. If the middle portion is deformed excessively, the deformation of the shield portion beyond a predetermined amount is regulated since the regulating portion thereof abuts against the outer surface of the sidewall.

As described above, in the present invention, the shield portion is not deformed away from, or does not become too close to the outer surface of the sidewall. As a result, it is possible to ensure the insulating distance properly and certainly by maintaining a necessary distance between the outer surface of the sidewall and the shield portion. In addition, it is also possible to prevent the shield portion from interfering with the other electrical devices adjacent to the electrical connector since the shield portion is not deformed so as to be away from the outer surface of the sidewall.

Further, in the present invention, it is preferable that the electrical connector includes two shield plates having the same shape with each other and attached to the housing at a position symmetrical to each other. When the two shield plates are attached to the housing symmetrically to each other, both of the sidewalls of the housing are covered. Accordingly, comparing to a case that only one sidewall is covered with the shield plate, it is possible to increase a shielding effect. In addition, the two shield plates have the same shape. Therefore, it is not necessary to prepare a mold for each of the shield plates. As a result, it is possible to reduce cost for manufacturing the shield plate.

Furthermore, in the present invention, it is preferable that the regulating portion is disposed on the shield portion at a center thereof in the longitudinal direction. It is possible to certainly regulate the excessive deformation of the shield portion toward the outer surface of the sidewall of the housing, by providing the regulating portion at the center of the shield portion in the longitudinal direction, where the shield portion is deformed most.

As described above, in the present invention, the shield portion of the shield plate includes the regulating portion capable of abutting against the outer surface of the sidewall of the housing. Therefore, when the shield portion is deformed by bending toward the sidewall of the housing due to the manufacturing variance, the assembling variance or the inadvertent external force and the like, the regulating portion abuts against the outer surface of the sidewall. Thereby, the regulating portion regulates further deformation of the shield portion. Accordingly, the shield portion and the outer surface of the sidewall can maintain the necessary space therebetween, thereby maintaining the insulating distance properly. Consequently, it is possible to obtain a good shielding state.

DETAILED DESCRIPTION OF THE PREFERRED EMBODIMENTS

Hereunder, embodiments of the present invention will be explained with reference to the accompanying drawings.

First Embodiment

Figure 1:
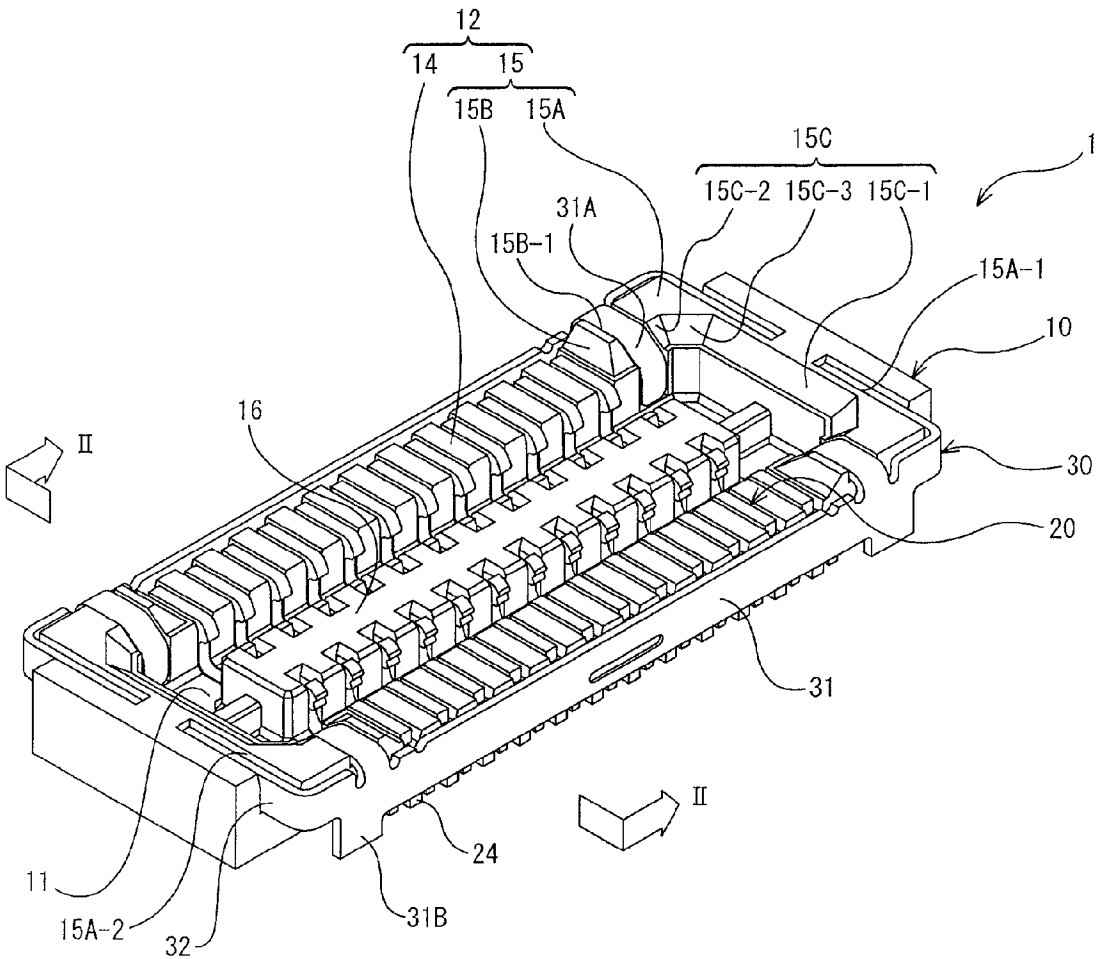
FIG. 1 is a perspective view showing an electrical connector according to a first embodiment of the present invention.
Figure 2:
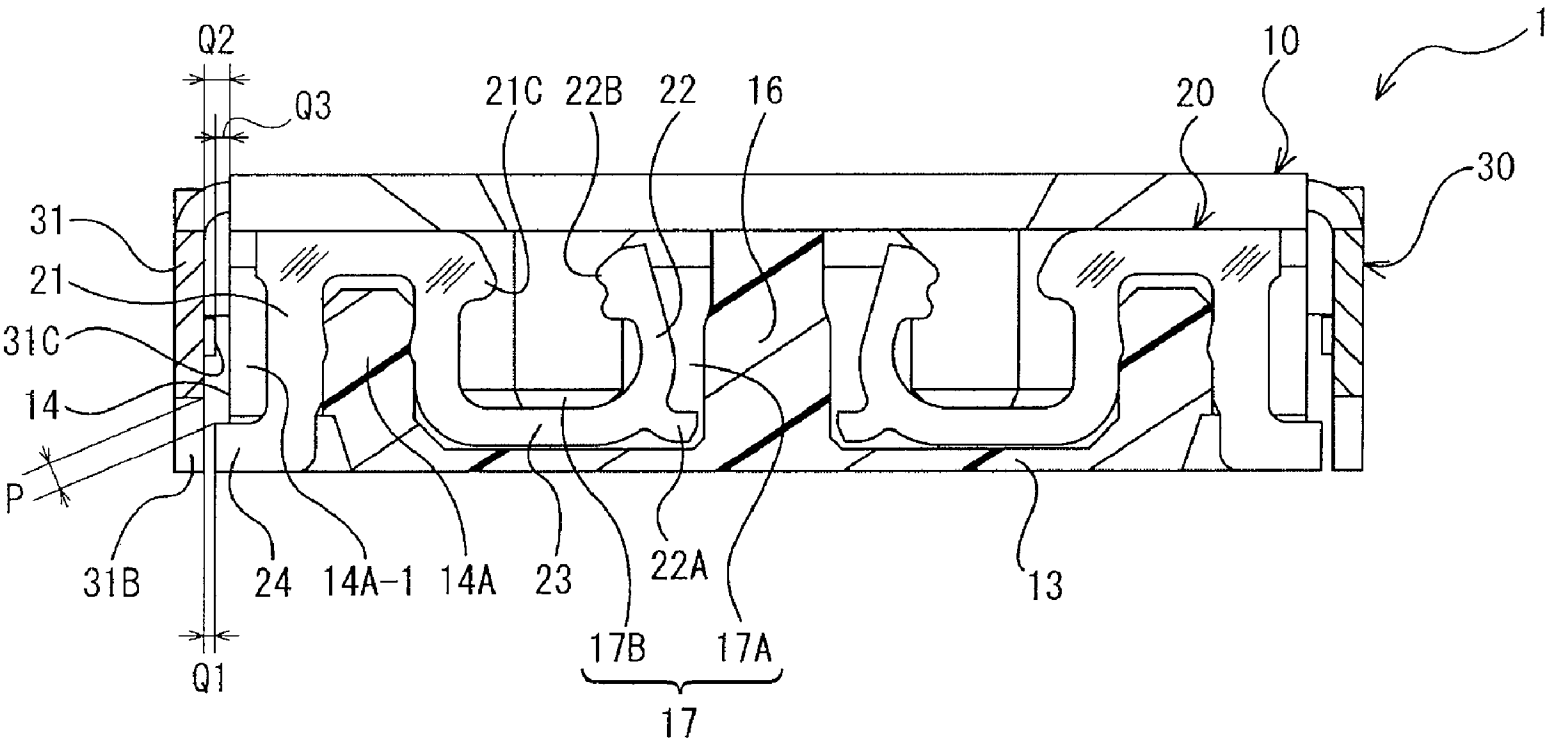
FIG. 2 is a sectional view taken along a line II-II in FIG. 1.

FIG. 1 is a perspective view showing an electrical connector according to the embodiment. FIG. 2 is a sectional view showing the electrical connector, taken along a line II-II in FIG. 1, that is, where a terminal is situated. The electrical connector 1 (the connector 1) according to the embodiment receives a mating connector (not shown) from an upper direction, thereby being connected to the mating connector. The connector 1 includes a housing 10, a plurality of the terminals 20, and two shield plates 30. The housing 10 is made from a synthetic resin and has an outer shape of a substantially rectangular parallelepiped. The terminal 20 is made from a metal plate. Further, the plurality of the terminals 20 are arranged and held in the housing 10 in a longitudinal direction of the housing 10. The shield plate 30 is made from a metal plate and attached to the housing 10. The terminals 20 are arranged in two lines. As shown in FIG. 2, both of the lines face one another in a horizontal direction in FIG. 2, in other words, in a direction perpendicular to the longitudinal direction of the housing (a direction perpendicular to a sheet surface). Hereunder, the longitudinal direction of the housing 10 will be described as "a terminal arranging direction" and a direction perpendicular to the terminal arranging direction or the horizontal direction in FIG. 2 will be described as "a terminal facing direction".

The housing 10 includes a receptacle recess portion 11. The receptacle recess portion 11 for receiving the mating connector opens toward the upper direction. The receptacle recess portion 11 is composed of inner wall surfaces of a circumference wall portion 12, an upper surface of a bottom wall portion 13 and side surfaces of a central wall portion 16 (described later) of the housing 10. The circumference wall portion 12 of the housing 10 includes two sidewall portions 14 and two edge wall portions 15. The sidewall portions 14 extend in the longitudinal direction of the housing 10 and face each other. The edge wall portion 15 extends perpendicular to the longitudinal direction and connects to end portions of the sidewall portions 14.

Further, as shown in FIGS. 1 and 2, the housing 10 includes the central wall portion 16 protruding from the upper surface of the bottom wall portion 13. The central wall portion 16, as shown in FIG. 1, has an island shape in the center of the receptacle recess portion 11. The central wall portion 16 is surrounded by the receptacle recess portion 11.

As shown in FIG. 2, the housing 10 has a symmetrical shape about the central wall portion 16. Therefore, it will be explained about a left half portion of the housing 10 in FIG. 2 and an explanation about a right half portion of the housing 10 will be omitted.

The housing 10 includes a holding groove portion 17 disposed in the terminal arranging direction with an equal interval. The retaining groove portion 17 holds a contacting portion 22 and a combining portion 23 (described later) of the terminal 20 made from the metal plate so as to maintain a plate surface. The holding groove portion 17 is dented in the horizontal direction in FIG. 2 and in a lower direction, on the side surface of the central wall portion 16 and on the upper surface of the bottom wall portion 13, respectively. In addition, the holding groove portion 17 is dented by a width approximately the same with a thickness of the metal plate of the terminal 20. As shown in FIG. 2, the holding groove portion 17 includes an inner holding groove portion 17A extending in a vertical direction (a connecting direction) along the side surface of the central wall portion 16 and a lower holding groove portion 17B extending in the horizontal direction (the terminal facing direction) along the bottom wall portion 13. The inner holding groove portion 17A and the lower holding groove portion 17B are connected to each other.

The housing 10 further includes a terminal retaining portion 14A for retaining the terminal 20 in the sidewall portion 14 thereof. As shown in FIG. 2, the terminal retaining portion 14A has a retaining groove portion 14A-1. The retaining groove portion 14A-1 is dented from an outer surface of the sidewall portion 14 by a depth being capable of retaining a retained portion 21 (described later) of the terminal 20. The retained portion 21 has an upside-down U-letter shape. The retaining groove portion 14A-1 has a width approximately the same with a width of the terminal 20 and receives the retained portion 21. Thereby, the terminal retaining portion 14A retains the retained portion 21.

The edge wall portion 15 is situated in both ends of the sidewall portion 14. The edge wall portion 15 includes a main edge wall portion 15A extending in the terminal facing direction and a secondary edge wall portion 15B extending from both ends of the main edge wall portion 15A in the terminal arranging direction and being continued through the sidewall portion 14. The edge wall portion 15 combines the end portions of two sidewall portions 14. Therefore, the edge wall portion 15 has a substantially U-letter shape as being viewed from above.

The edge wall portion 15 is taller than the sidewall portion 14. An upper surface of the edge wall portion 15 is situated above an upper surface of the sidewall portion 14. The edge wall portion 15 includes a guiding surface 15C on an upper surface thereof. The guiding surface 15C is formed throughout an inner edge portion of the upper surface with the substantially U-letter shape upon being viewed from above. The guiding surface 15C is beveled in the lower direction toward the receptacle recess portion 11. The guiding surface 15C guides the mating connector toward the receptacle recess portion 11 as the connector 1 receives the mating connector from the upper direction. The guiding surface 15C includes a surface 15C-1 extending in the terminal facing direction, a surface 15C-2 extending in the terminal arranging direction, and a surface 15C-3 extending obliquely against both of the terminal facing direction and the terminal arranging direction. The surface 15C-3 combines the surface 15C-1 and the surface 15C-2. The surfaces 15C-1, 15C-2 and 15C-3 guide the mating connector in the terminal arranging direction, the terminal facing direction and both of the terminal arranging direction and the terminal facing direction, respectively.

As shown in FIG. 1, the main edge wall portion 15A includes a holding portion 15A-1 for holding the shield plate 30. The holding portion 15A-1 is formed symmetrically about the center of the main edge wall portion 15A in the terminal facing direction. The holding portion 15A-1 includes a slit portion situated in an upper half portion of the main edge wall portion 15 and two hole portions (not shown) extending from a bottom portion of the slit portion in the lower direction. The slit portion extends in a direction perpendicular to the terminal arranging direction and opens outward in the terminal facing direction and toward the upper direction. As described later, a held portion 32 of the shield plate 30 is inserted into the slit portion of the holding portion 15A-1 from the upper direction as well as a pressing leg portion 32A of the held portion 32 is pressed into the hole portion from the upper direction. In addition, the holding portion 15A includes a guiding surface 15A-2 for guiding the held portion 32 of the shield plate 30 in upper edges of all three circumferences thereof.

The secondary edge wall portion 15B includes a ground piece holding groove 15B-1 for holding a ground piece 31A (described later) of the shield plate. The ground piece holding groove 15B-1 is dented by a depth capable of holding the ground piece 31A, which extends through an upper surface of the secondary edge wall portion 15B, the surface 15C-2 and an inner wall surface of the secondary edge wall portion 15B. The ground piece holding groove 15B-1 has a width slightly larger than the ground piece 31A.

The terminal 20 is formed by punching out the metal plate so as to maintain a flat plate surface. As show in FIG. 2, the terminal 20 has a substantially lateral S-letter shape. In FIG. 2, the plate surface of the terminal 20 is parallel with the sheet surface. The terminals 20 facing each other in the horizontal direction have the same shape. Therefore, in the embodiment, a configuration of the terminal 20 situated in left side will be explained and an explanation of the terminal 20 situated in right side will be omitted.

As shown in FIG. 2, the terminal 20 situated in the left side includes the retained portion 21, the contacting portion 22, the combining portion 23 and a connecting portion 24. The retained portion 21 has an upside down U-letter shape and is situated close to outside the connector 1 in the horizontal direction or the terminal facing direction. Further, the retained portion 21 is held over the terminal retaining portion 14A of the housing 10. The contacting portion 22 is situated in the inner holding groove portion 17A and extends in the vertical direction or the connecting direction having a slight space against the central wall portion 16 in the horizontal direction. The contacting portion 22 is flexible. The combining portion 23 is situated in the lower holding groove portion 17B extending in the horizontal direction. The combining portion 23 combines a lower end of the contacting portion 22 and a lower end situated closer to the central wall portion 16 of the retained portion 21. The connecting portion 24 extends from a lower end portion situated distant to the central wall portion 16 of the retained portion 21 toward outside the connector 1 in the horizontal direction.

The retained portion 21 includes an engaging portion 21C in an upper end of a closer side to the central wall portion 16 thereof. The engaging portion 21C protrudes toward the central wall portion 16. The engaging portion 21C engages an engaged portion with a dented shape of a terminal of the mating connector (a mating terminal) as the connector 1 is connected to the mating connector. The engaging portion 21C prevents the mating connector from coming off inadvertently by engaging the engaged portion.

The contacting portion 22 includes a stopper portion 22A at a lower end thereof. The stopper portion 22A protrudes toward the central wall portion 16. The stopper portion 22A abuts against the central wall portion when the mating connector is extracted from the connector 1. Thereby, the stopper portion 22A controls the terminal 20 of the connector 1 to move in the upper direction (a connector extracting direction). Furthermore, the contacting portion 22 includes a contacting protrusion 22B in an upper end thereof. The contacting protrusion 22B protrudes toward the terminal retaining portion 14A and elastically contacts a corresponding contacting portion of the mating terminal.

Figure 3:
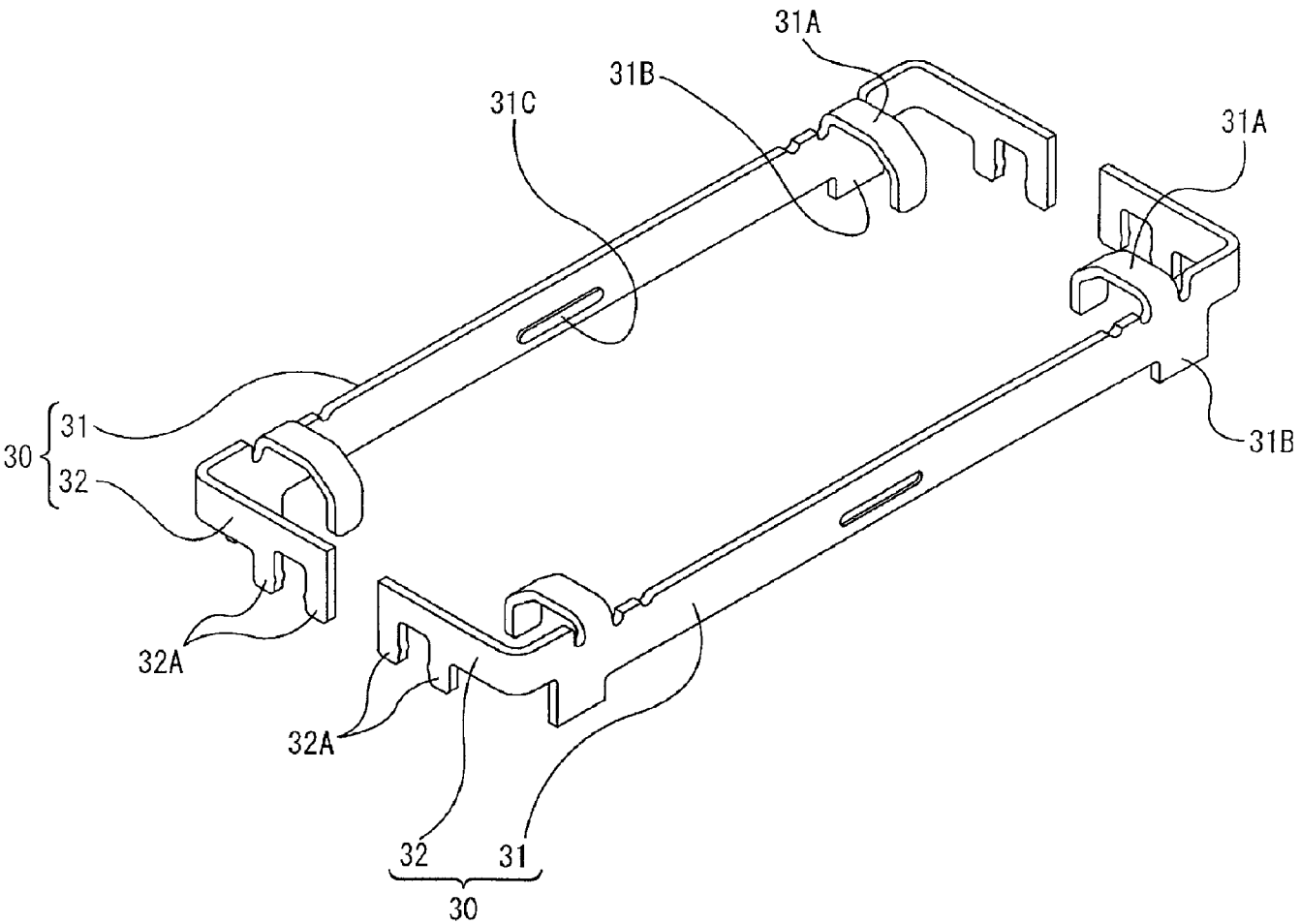
FIG. 3 is a perspective view showing a shield plate of the electrical connector shown in FIG. 1.
Figure 4:
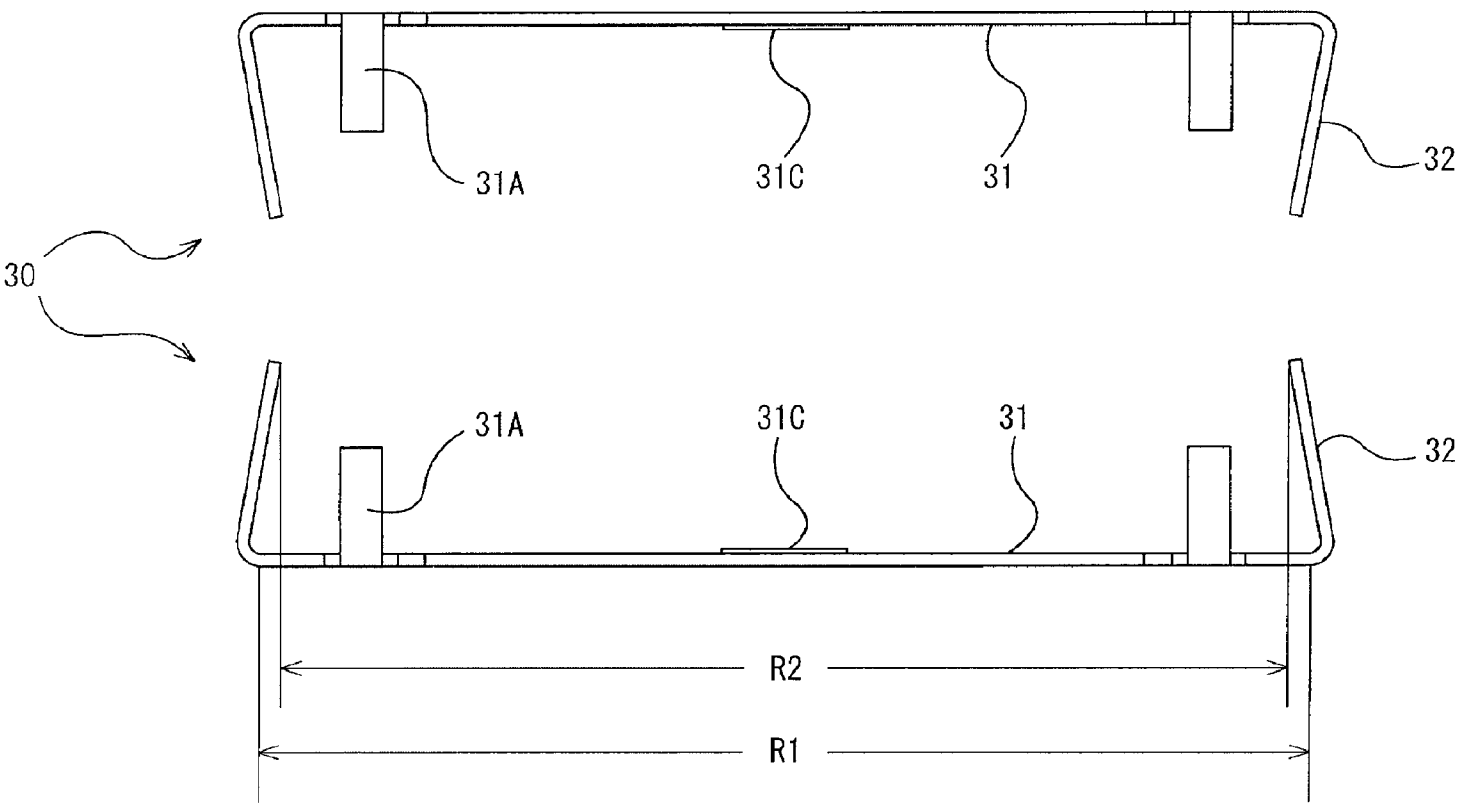
FIG. 4 is a plan view showing the shield plate in a free state before being attached to a housing.

FIG. 3 is a perspective view showing the shield plate 30 of the connector 1. FIG. 4 is a plan view showing the shield plate 30 in a free state before being attached to the housing 10. Hereunder, a configuration of the shield plate 30 will be explained with reference to not only FIGS. 1 and 2, but also FIGS. 3 and 4.

The shield plate 30 is formed by punching out and then bending the metal plate. In the embodiment, as shown in FIG. 1, a pair of the shield plates 30 with the same shape is attached to the housing 10 so as to be symmetrical about the terminal arranging direction. The shield plate 30 includes a shield portion 31 and two held portions 32. As shown in FIG. 1, the shield portion 31 extends in the terminal arranging direction along the outer surface of the sidewall portion 14, thus covers the outer surface of the sidewall portion 14 throughout the terminal arranging direction. The held portions 32 are formed by bending both end portions of the shield portion 31. Further, the held portion 32 is held by the holding portion 15A-1 of the housing 10. As shown in FIG. 4, a length R1 of the shield plate 30 in a longitudinal direction thereof is equal to a distance between the holding portions 15A-1 situated both ends of the housing 10. In the embodiment, both of the sidewall portions 14 of the housing 10 are covered with the shield portions 31, by attaching two shield plates 30 to the housing 10. Therefore, it is possible to increase a shielding effect.

The shield portion 31 includes the ground piece 31A. The ground pieces 31A are situated at both ends of the shield portion 31 in the longitudinal direction and extends from an upper edge portion of the shield portion 31. The ground piece 31A contacts a ground terminal of the mating connector when the connector 1 is connected to the mating connector. As shown in FIG. 3, the ground piece 31A is bent at an approximate right angle at the upper edge portion of the shield portion 31 in the same direction as the direction in which the held portion 32 extends. In addition, the ground piece 31A is bent at two points in a middle portion thereof. Accordingly, a distal portion thereof extends toward the lower direction.

As shown in FIG. 1, the ground piece 31A is bent at two points in the middle portion thereof as described above. Therefore, when the shield plate 30 is attached to the housing 10, the ground piece 31A is held in the ground piece holding groove 15B-1 of the housing 10 and extends along the ground piece holding groove 15B-1. Further, a slight space is generated between the ground piece 31A and an inner wall surface of the ground piece holding groove 15B-1 in the width direction thereof. Furthermore, the ground piece 31A is not situated above the surface 15C-2 of the guiding surface 15C. Therefore, when the connector 1 is connected to the mating connector, the mating connector does not interfere with the ground piece 31A. As a result, it is easy to guide the mating connector with the surface 15C-2.

The shield portion 31 further includes two ground leg portions 31B at both ends in the longitudinal direction thereof. The ground leg portion 31B extends from a lower edge portion of the shield portion 31 toward the lower direction. The ground leg portion 31B is soldered to a ground circuit portion of a circuit board (not shown) on which the connector 1 is mounted. As shown in FIG. 1, the ground leg portion 31B is situated out of a region where the terminals are disposed. In addition, the connecting portions 24 of all of the terminals 20 situated between the ground leg portions 31B are not covered with the shield portion 31 upon being viewed from where the circuit board is situated in the horizontal direction. Accordingly, it is possible to confirm visually that the connecting portion 24 of the terminal 20 is soldered to a corresponding circuit portion of the circuit board when the shield plate 30 is attached to the housing 10.

As shown in FIG. 3, the shield portion 31 includes a regulating portion 31C in a central portion in the longitudinal direction thereof. The regulating portion 31C protrudes in the direction the held portion extends, in other words, toward the sidewall portion 14 of the housing 10 in FIGS. 1 and 2. The regulating portion 31C is formed by, for example, embossing. As shown in FIG. 2, when the shield plate 30 is attached to the housing 10, the regulating portion 31C is situated in a range of the sidewall portion 14 of the housing 10 in the vertical direction.

When the shield plate 30 is made correctly, in other words, is made without a manufacturing error or an assembling error and attached to the housing 10, as shown in FIG. 2, the regulating portion 31C and the sidewall portion 14 generate a space therebetween. As described later, when the shield portion 31 is deformed by bending toward the outer surface of the sidewall portion 14 due to an external force and the like, the regulating portion 31C abuts against the outer surface of the sidewall portion 14. Thereby, the regulating portion 31C regulates further deformation of the shield portion 31 so that the shield portion 31 is not deformed excessively.

In FIG. 2, a distance P between the lower edge of the shield portion 31 and an upper edge portion of the left end portion of the connecting portion 24 of the terminal 20, that is, the shortest distance between the shield portion 31 and the terminal 20 is a so-called an insulating distance. When the insulating distance P is ensured properly, it is possible to obtain a good shielding state. The connecting portion 24 is fixed in both of the vertical and horizontal directions while the shield portion 31 is fixed only in the vertical direction. Therefore, in order to ensure the insulating distance P properly, it is necessary to determine a distance Q1 between the shield portion 31 and an edge portion of the connecting portion 24 in the horizontal direction properly. Determining the distance Q1 is equivalent to determining a distance Q2 between the shield portion 31 and the outer surface of the sidewall portion 14. Further, a distance Q3 between a protruding top of the regulating portion 31C and the outer surface of the sidewall portion 14, or an amount the regulating portion 31C protrudes from the shield portion 31, is determined in order to ensure the distance Q2 in a proper range. Accordingly, the proper insulating distance P can be obtained by determining the distance Q3 properly.

As shown in FIG. 3, the held portion 32 includes the pressing leg portion 32A extending in the lower direction from a lower edge portion thereof. The pressing leg portion 32A is pressed into the hole portion of the holding portion 15A-1 of the housing 10 when the shield plate 30 is attached to the housing 10 from the upper direction.

As shown in FIG. 4, when the shield plate 30 is in a free state prior to being attached to the housing 10, both of the held portions 32 extend so as to come close to each other. In other words, in the free state, the held portion 32 has a flexion angle less than the right angle, which is an angle the shield plate 30 is attached to the housing 10. Accordingly, a distance R2 between the held portions 32 in the longitudinal direction of the shield portion 31 is shorter than the length R1 of the shield portion 31 in a longitudinal direction thereof. As described above, the length R1 of the shield portion 31 in the longitudinal direction thereof is equal to the distance between the holding portions 15A-1 situated both ends of the housing 10. Therefore, the distance R2 is shorter than the distance between the holding portions 15A-1.

The connector 1 having a configuration described above is assembled in a following order. First, the terminal 20 is arranged in the housing 10. More specifically, the terminal 20 is attached into the terminal retaining portion 14A of the housing 10 from the upper direction in FIG. 2. When the terminal 20 is attached into the terminal retaining portion 14A, the retained portion 21 thereof maintains the upside down U-letter shape and the edge portion of the connecting portion 24 thereof extends toward outside the connector 1 in the terminal facing direction. That is, the terminal retaining portion 14A is inserted between two leg portions of the upside down U-letter shape of the retained portion 21. Further, the contacting portion 22 and the combining portion 23 are settled in the inner holding groove portion 17A and the lower holding groove portion 17B, respectively. Furthermore, the engaging portion 21C and the contacting protrusion 22B protrude from the terminal retaining groove portion 14A-1 and the inner holding groove portion 17A, respectively.

Next, two shield plates 30 are attached to the housing 10. In concrete terms, the held portion 32 is inserted into the holding portion 15A-1 from the upper direction as the pressing leg portion 32A thereof extends in the lower direction. The held portion 32 is inserted until the pressing leg portion 32A is pressed into the hole portion of the holding portion 15A-1 of the housing 10 after being guided by the guiding surface 15A-2. When the guiding surface 15A-2 is formed relatively larger at a portion close to the terminals 20 thereof, it becomes easier to insert the held portion 32 since it becomes easier to guide the held portion 32.

As described above, when the shield plate 30 is in the free state, the flexion angle between the shield portion 31 and the held portion 32 is less than the right angle which is the angle the shield plate 30 is attached to the housing 10. Accordingly, when the held portion 32 of the shield plate 30 is inserted into the holding portion 15A-1 of the housing 10, the held portion 32 is bent outwardly so as to open to the right angle. As a result, a middle portion of the shield portion 31 in the longitudinal direction is deformed by bending toward the outer surface of the sidewall portion 14 of the housing 10. In the embodiment, as described above, when the shield portion 31 deformed toward the outer surface of the sidewall portion 14 in some reason, as shown in FIG. 2, the regulating portion 31C and the outer surface of the sidewall portion 14 maintain the necessary space therebetween.

In addition, the ground piece 31A of the shield plate 30 is held in the ground piece holding groove 15B-1. By attaching the shield plate 30 to the housing as described above, the connector 1 is assembled completely.

The connector 1 according to the embodiment, as described above, the regulating portion 31C is provided in the shield portion 31 of the shield plate 30. In addition, the regulating portion 31C is capable of abutting against the outer surface of the sidewall portion 14 of the housing 10. Therefore, when the shield portion 31 is deformed toward the sidewall portion 14 of the housing 10 due to the manufacturing error, the assembling error or the inadvertent external force and the like, the regulating portion 31C abuts against the outer surface of the sidewall portion 14. Thereby, the regulating portion 31C regulates further deformation of the shield portion 31. Accordingly, the shield portion 31 and the outer surface of the sidewall portion 14 enable to maintain the necessary space therebetween, thereby maintaining the insulating distance properly. Consequently, it is possible to obtain the good shielding state.

In the embodiment, as described above, the shield plate 30 has the flexion angle less than the right angle, which is the angle when the shield plate 30 is attached to the housing 10. Accordingly, when the shield plate 30 is attached to the housing 10, the middle portion of the shield portion 31 is deformed toward the outer surface of the sidewall portion 14 of the housing 10. Therefore, the shield plate 30 is not deformed so as to be away from the outer surface of the sidewall portion 14. As a result, it is also possible to prevent the shield portion 31 from interfering with other electrical devices adjacent to the connector 1.

In addition, if the shield portion 31 is deformed excessively, the deformation beyond a predetermined amount of the shield portion 31 is regulated since the regulating portion 31C thereof abuts against the outer surface of the sidewall portion 14. Therefore, as well as preventing the shield portion 31 from being too close to the outer surface of the sidewall portion 14, the shield portion 31 and the outer surface of the sidewall portion 14 maintain the predetermined space therebetween, thereby maintaining the insulating distance properly and certainly.

In the embodiment, two shield plates 30 to be attached to the housing 10 have the same shape. Accordingly, it is not necessary to prepare a mold for each of the shield plates. As a result, it is possible to reduce cost for manufacturing the shield plate 30.

In the embodiment, the regulating portion 31C of the shield plate 30 is provided on the middle portion of the shield portion 31 in the longitudinal direction, where the shield portion 31 is deformed most upon receiving the external force and the like. Therefore, the deformation of the shield portion 31 toward the sidewall portion 14 of the housing 10 can be regulated certainly, so that the shield portion 31 is not deformed beyond the predetermined amount.

In the embodiment, in the free state, the flexion angle of the shield plate is less than the right angle. Further, the held portion of the shield plate is inserted into the holding portion of the housing extending perpendicularly to the terminal arranging direction. Configurations of the shield plate and the housing are not limited to the case described above. It is only necessary that the shield plate has an interval between the held portions thereof larger than the interval in the free state which a state is before being attached to the housing when the shield plate is attached to the housing.

In the embodiment, the shield plate includes one regulating portion in the shield portion thereof. The shield plate may include a plurality of the regulating portions. By providing the plurality of the regulating portions, it is possible to regulate the excessive deformation of the shield portion toward the sidewall portion of the housing more certainly.

In addition, in the embodiment, the regulating portion of the shield plate is formed so as to have the space against the outer surface of the sidewall portion of the housing when the shield plate is attached to the housing. The regulating portion may be formed so as to abut against the outer surface of the sidewall portion when the shield plate is attached to the housing.

Second Embodiment

The connector according to a second embodiment has a regulating portion formed by folding back a portion of the shield portion, while the connector according to in the first embodiment has the regulating portion formed by embossing a plate surface of the shield portion. A basic configuration of the connector according to the embodiment is the same with the connector according to the first embodiment. Therefore, the regulating portion different from the first embodiment will be explained mainly. An explanation about the same components will be omitted and the same reference numerals with the first embodiment will be assigned to corresponding components.

Figure 5:
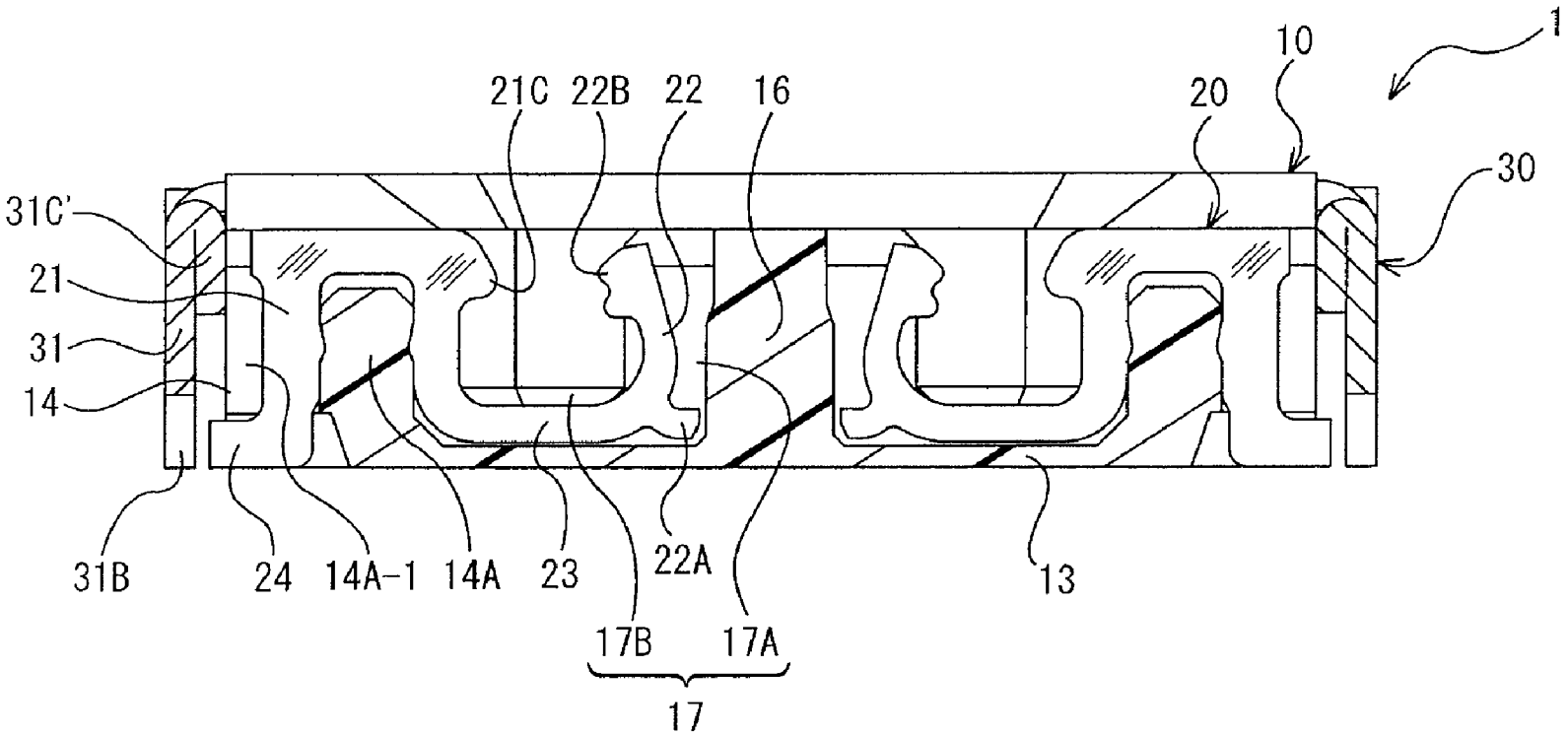
FIG. 5 is a sectional view showing an electrical connector according to a second embodiment of the present invention.

FIG. 5 is a sectional view showing the connector according to the embodiment, taken at a position the terminal is situated and along a direction perpendicular to the terminal arranging direction. In the embodiment, as shown in FIG. 5, the regulating portion 31C' is formed by folding back a protruding piece in the lower direction toward the terminal 20. The protruding piece is provided in the upper edge of the middle portion of the shield portion 31 in the longitudinal direction of the shield plate 30.

As shown in FIG. 5, the regulating portion 31C' abuts against the outer surface of the sidewall portion 14 with a plate surface thereof. Further, except where the regulating portion 31C' is situated, a space is generated between the shield portion 31 and the outer surface of the sidewall portion 14 by a thickness of the plate of the regulating portion 31C'.

In the embodiment, when the shield portion 31 receives a force causing deformation thereof by bending toward the sidewall portion 14 due to the manufacturing error, the assembling error or the inadvertent external force and the like, it is possible to regulate further deformation of the shield portion 31 since the regulating portion 31C' abuts against the outer surface of the sidewall portion 14. As a result, the shield portion 31 and the outer surface of the sidewall portion 14 maintain the space therebetween, thereby maintaining the insulating distance properly.

In the embodiment, the regulating portion abuts against the outer surface of the sidewall portion as the shield plate is attached to the housing. The regulating portion may generate a space against the outer surface of the sidewall portion.

Third Embodiment

The connector according to a third embodiment has a regulating portion formed by bending a portion of the shield portion in a right angle, while the connector according to in the first embodiment has the regulating portion formed by embossing the plate surface of the shield portion. A basic configuration of the connector according to the embodiment is the same with the connector according to the first embodiment. Therefore, the regulating portion different from the first embodiment will be explained mainly. An explanation about the same components will be omitted and the same reference numerals with the first embodiment will be assigned to corresponding components.

Figure 6:
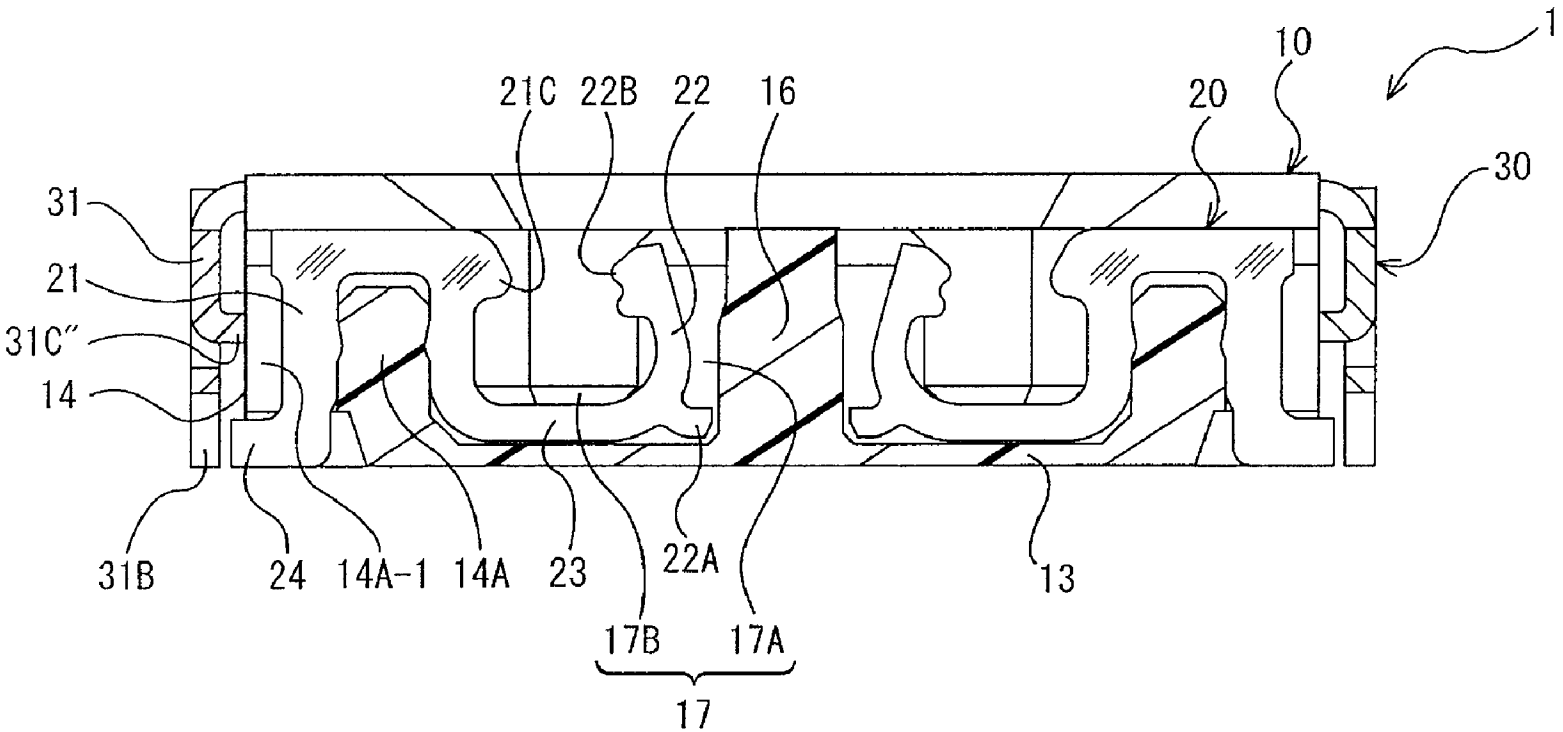
FIG. 6 is a sectional view showing an electrical connector according to a third embodiment of the present invention.

FIG. 6 is a sectional view showing the connector according to the embodiment, taken at a position the terminal is situated and along a direction perpendicular to the terminal arranging direction. In the embodiment, as shown in FIG. 6, the regulating portion 31C" is formed by bending a cutting portion in the right angle toward the terminal 20. The cutting portion is provided in the upper edge of the middle portion of the shield portion 31 in the longitudinal direction of the shield plate 30.

As shown in FIG. 6, the regulating portion 31C" abuts against the outer surface of the sidewall portion 14 with a forefront surface thereof. Further, except where the regulating portion 31C" is situated, a space is generated between the shield portion 31 and the outer surface of the sidewall portion 14 by a length of the regulating portion 31C". In the embodiment, when the shield portion 31 receives the force causing deformation thereof by bending toward the sidewall portion 14 due to the manufacturing error, the assembling error or the inadvertent external force and the like, it is possible to regulate further deformation of the shield portion 31 since the regulating portion 31C" abuts against the outer surface of the sidewall portion 14. As a result, the shield portion 31 and the outer surface of the sidewall portion 14 maintain the space therebetween, thereby maintaining the insulating distance properly.

In the embodiment, the regulating portion abuts against the outer surface of the sidewall portion as the shield plate is attached to the housing. The regulating portion may generate a space against the outer surface of the sidewall portion.

The disclosure of Japanese Patent Application No. 2009-275240 filed on Dec. 3, 2009 is incorporated in the application by reference.

While the invention has been explained with reference to the specific embodiments of the invention, the explanation is illustrative and the invention is limited only by the appended claims.

What is claimed is:

1. An electrical connector, comprising:

a plurality of terminals arranged in a first direction;

a housing having a sidewall, an edge wall at an end portion of the sidewall in the first direction, and a holding portion disposed on the edge wall; and a first shield plate attached to the housing away from the sidewall by a specific distance, said first shield plate including a shield portion covering an outer surface of the sidewall, a held portion supported on the holding portion, and a regulating portion capable of abutting against the outer surface of the sidewall, wherein said regulating portion is arranged to protrude inwardly toward the sidewall in a second direction perpendicular to the first direction, and is situated away from the sidewall in the second direction so that the regulating portion contacts with the sidewall only when the first shield plate deforms toward the sidewall.

2. The electrical connector according to claim 1, wherein said first shield plate is attached to the housing so that the held portion is deformed outwardly in the first direction.

3. The electrical connector according to claim 1, further comprising a second shield plate attached to the housing at a position symmetrical to the first shield plate, said second shield plate having a shape substantially the same as that of the first shield plate.

4. The electrical connector according to claim 1, wherein said regulating portion is disposed on the shield portion, at a center thereof in the first direction.

* * * * *